US007780437B2

(12) United States Patent
Bernero et al.

(10) Patent No.: US 7,780,437 B2
(45) Date of Patent: Aug. 24, 2010

(54) PREMIX BURNER

(76) Inventors: Stefano Bernero, Im Kehl 6, CH-5400 Baden (CH); Christian Joerg Matz, Pilgerstrasse 4, CH-5405 Baden-Daettwil (CH); Martin Zajadatz, Sonnenrain 25, D-79790 Kuessaberg (DE); Christian Oliver Paschereit, Lohengrinstrasse 29, D-14109 Berlin (DE)

( * ) Notice: Subject to any disclaimer, the term of this patent is extended or adjusted under 35 U.S.C. 154(b) by 1281 days.

(21) Appl. No.: 11/237,848

(22) Filed: Sep. 29, 2005
(Under 37 CFR 1.47)

(65) Prior Publication Data

US 2006/0183069 A1 Aug. 17, 2006

(30) Foreign Application Priority Data

Oct. 11, 2004 (DE) ..... 10 2004 049 491

(51) Int. Cl.
*F23D 11/38* (2006.01)
*F23D 11/02* (2006.01)
*F23C 3/00* (2006.01)

(52) U.S. Cl. ..... 431/75; 431/12; 431/18; 431/19; 431/278; 431/285; 431/350

(58) Field of Classification Search ..... 431/12, 431/278, 285, 350, 18, 114, 75; 60/725
See application file for complete search history.

(56) References Cited

U.S. PATENT DOCUMENTS 7,198,483 B2 * 4/2007 Bueche et al. ..... 431/12

FOREIGN PATENT DOCUMENTS

| | | | |
|---|---|---|---|
| DE | 100 64 893 | | 11/2002 |
| DE | 101 64 099 | * | 7/2003 |
| DE | 101 60 907 | * | 8/2003 |
| DE | 103 34 228 | * | 3/2004 |
| EP | 0 321 809 | | 6/1989 |
| EP | 0 704 657 | | 4/1996 |
| EP | 1 235 033 | * | 2/2002 |
| EP | 1 202 653 | * | 5/2002 |
| WO | WO01/96785 | | 12/2001 |
| WO | WO 02/052201 | * | 7/2002 |
| WO | WO 02/061335 | * | 8/2002 |

* cited by examiner

*Primary Examiner*—Carl D Price
(74) *Attorney, Agent, or Firm*—Cermak Nakajima LLP; Adam J. Cermak

(57) ABSTRACT

A premix burner includes a vortex generator (30) for combustion air stream (15), devices (17, 17*a*, 17*b*, 31-38, 41-48) to inject fuel into the combustion air stream (15), and tangential air ducts (19, 20). The combustion air (15) enters the cone cavity (14) of the vortex generator (30) via the air ducts. The injection of the fuel into the combustion air is done asymmetrically by injection devices (17, 17*a*, 17*b*, 31-38, 41-48). At least one of the injection devices (5) is arranged on a fuel lance (3) that extends into the vortex chamber.

12 Claims, 5 Drawing Sheets

PREMIX BURNER

This application claims priority under 35 U.S.C. §119 to German patent application number 10 2004 049 491.6, filed 11 Oct. 2004, the entirety of which is incorporated by reference herein.

BACKGROUND OF THE INVENTION

1. Field of the Invention

The invention is based on a burner.

2. Brief Description of the Related Art

Premix burners that are operated based on the concept of lean premix combustion, have low pollutant emissions but also a clearly restricted stability and operating range. These restrictions are caused by flashback into the mixing zone of the burner and lift-off and extinguishing of the premix flame as well as by thermo-acoustic oscillations. The stability range during conventional operation of a premix burner is expanded by using pilot injection that is especially used in the lower load range. However, already small amounts of 10% pilot gas, for example, can result in clearly increased pollutant emissions since the pilot flames work in diffusion operation. Pilot injection is turned off or reduced to the largest degree possible in the upper load range in order to guarantee low pollutant emissions.

In the case of the premix burner disclosed in EP 0 321 809 A1, a so-called double-cone burner, the pilot burner is realized by injecting fuel in the center of the vortex body, called double cone in this case. The gas that flows into the interior of the double-cone burner burns in a flame that is stabilized deep inside the interior space of the burner.

EP 0 704 657 A2 discloses another premix burner in which the pilot burner is realized by the fuel flowing from an annular gas channel with exit holes that are tilted to the outside into the outside backflow zone of the combustion chamber following the burner outlet. The gas that flows out burns in a flame that is stabilized by the cross section jump on the burner outlet.

Neither the embodiment of the external pilot system according to EP 0 704 657 A2 nor the internal pilot system according to EP 0 321 809 B1 can ensure optimum injection of the fuel across the entire load range in order to achieve the lowest possible pollutant emissions.

WO 01/96785 A1 discloses a burner with stepped premix gas injection in which a fuel lance extends into the vortex body. The fuel supply can be controlled so that exit openings on the fuel lance and exit openings on the vortex body can be fed, independent of each other, with premix gas. The exit openings on the vortex body and on the lance can be arranged so that no exit openings are arranged on the vortex body opposite the exit openings that are arranged on the lance.

SUMMARY OF THE INVENTION

One aspect of the present invention includes providing an optimum injection of fuel across the entire load range and to suppress even more effectively thermo-acoustic oscillations in a burner as described in the introduction.

Another aspect of the present invention includes achieving an incremental injection of the fuel into the combustion air by arranging a fuel lance that extends into the cone cavity and in which a part of the injected fuel in the tangential combustion air ducts is replaced with injected fuel on the fuel lance.

The advantages of the invention are, among other things, that the fuel is optimally injected across the entire load range. The incremental injection via the lance and additional injection openings means that premix burners can now be used for a broader operating range. The operation of these premix burners with incremental fuel supply covers at least the entire operating range of conventional pilot/premix burners.

In addition, asymmetric fuel injection can prevent pulsation even more effectively. The asymmetry refers to pairs of injection openings that are arranged opposite each other in flow direction and the injection openings on the lance. The asymmetry can be static by not arranging an injection opening across the area opposite an injection opening. This can also be achieved by individually controlling the fuel supply to the symmetrical fuel injection openings or by turning the lance. Using the control mechanism, opposite fuel injection openings then receive different amounts of fuel and, depending on the load point or starting or shutdown conditions, a symmetrical or asymmetrical fuel profile is obtained in the cone cavity of the vortex generator.

Furthermore, incremental fuel injection provides optimum operation with regard to an adjustment to the fuel composition since different fuels or fuel mixtures have different penetration depths, for example.

Other advantageous embodiments of the invention are disclosed in the following specification.

BRIEF DESCRIPTION OF THE DRAWINGS

The following paragraphs describe exemplary embodiments of the invention in more detail based on the drawings. Identical elements have the same reference character in the various figures. The direction of flow of the media is indicated with arrows.

The following is shown.

Only important elements that facilitate the understanding of the invention are shown; sections only provide a schematic, simplified presentation of the burner.

DETAILED DESCRIPTION OF EXEMPLARY EMBODIMENTS

Figure 1:
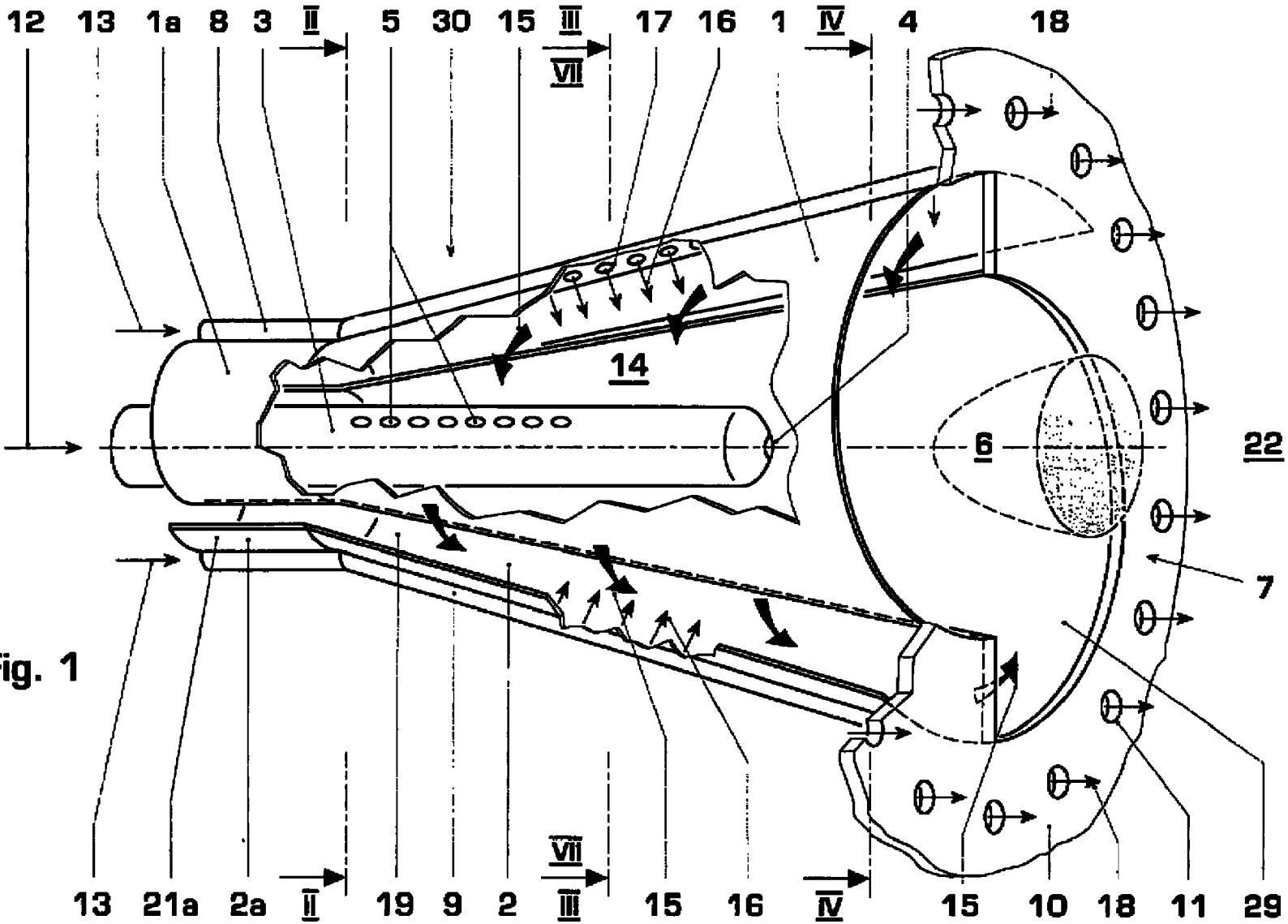
FIG. 1 a perspective view, with a partial cross section, of a burner.

The burner according to FIG. 1 includes a vortex generator 30 that mainly consists of two half, hollow conical body segments 1, 2, that are offset with regard to each other. Such a burner is called a double-cone burner. By offsetting the respective centerline 1*b*, 2*b* of the conical body segment 1, 2 with regard to each other one obtains a tangential air duct 19, 20, (FIG. 2-4) on both sides that are laterally reversed and through which the combustion air 15 flows into the interior space of the burner, i.e. into the cone cavity 14, also called vortex cavity. The two conical body segments 1, 2 have a cylindrical part 1*a*, 2*a* that also run offset with regard to each other analogously to the conical body segments 1, 2 so that the tangential air ducts 19, 20 are available from the start. A fuel lance 3 is arranged in this cylindrical segment 1*a*, 2*a* that extends into the cone cavity 14 downstream. Of course the burner can be cone-shaped, i.e. without a cylindrical segment

Figure 2:
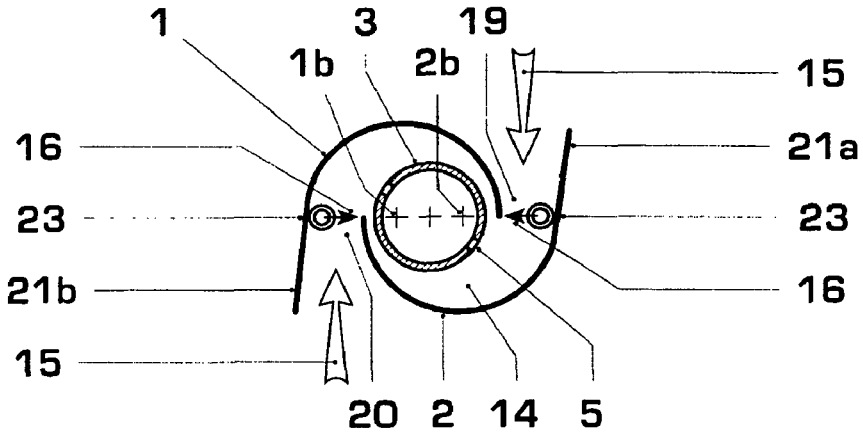
FIG. 2 a cross section through plane II-II in FIG. 1.
Figure 3:
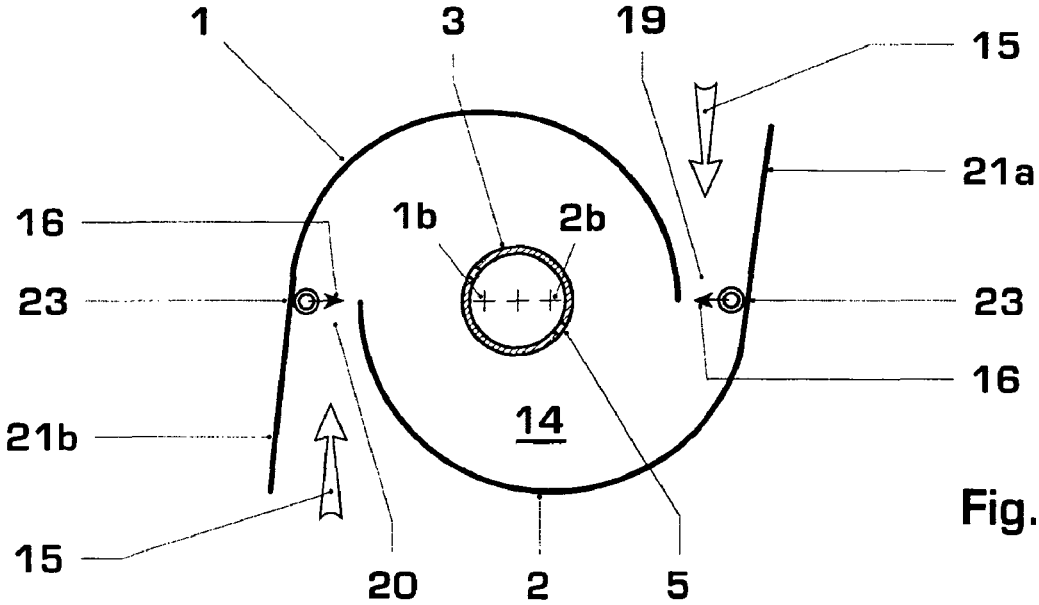
FIG. 3 a cross section through plane III-III in FIG. 1.
Figure 4:
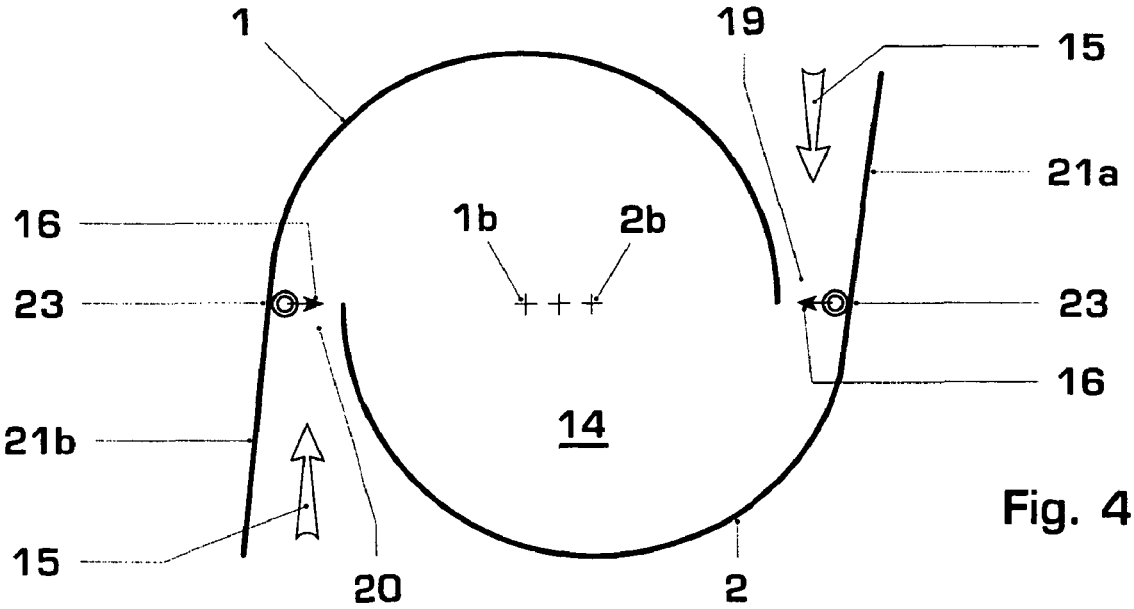
FIG. 4 a cross section through plane IV-IV in FIG. 1.

1*a*, 2*a*. Each conical body segment 1, 2 has a fuel line 8, 9 that has openings 17 through which the gaseous fuel 13 is mixed with the combustion air 15 that flows through the tangential air ducts 19, 20. The location of these fuel lines 8, 9 is schematically shown in FIG. 2-4. The fuel lines 8, 9 are arranged at the end of the tangential air ducts 19, 20 so that this is where the mixing 16 of the gaseous fuel 13 with inflowing combustion air 15 occurs. On the side of the combustion space in the combustion chamber 22 the burner, at burner outlet 29, has a collar-shaped back plate 10 that serves as an anchor for the conical body segments 1, 2 with a number of holes 11 through which diluent air or cooling air 18 can be supplied to the front segment of the burn cavity of the combustion chamber 22 or its wall, if necessary. Ignition occurs at the tip of the backflow zone 6. This is the point where a stable flame front 7 can occur. The probability of a return stroke of the flame into the interior of the burner, as is latently the case for premix stretches, is lower here.

The design of the conical body segments 1, 2 with regard to cone inclination and width of the tangential air ducts 19, 20 must be limited so that the desired flow field of the air with backflow zone 6 in the area of the burner opening is obtained for flame stabilization purposes. In general it must be said that a reduction of the tangential air ducts 19, 20 moves the backflow zone 6 further upstream, which would mean that the mixture would be ignited sooner. But it should be noted that once it is geometrically fixed, the backflow zone 6 maintains its position because the number of vortexes increases in the flow direction in the area of the cone shape of the burner.

The fuel lance 3 has openings 5 through which the gaseous fuel can be injected into the cone cavity 14 of the vortex generator. A fuel injection mechanism 4 can be arranged at the downstream end of the lance with the fuel injection mechanism being an air-supported jet or a mechanical atomizer, for example. Additional liquid fuel can be injected through this fuel injection mechanism 4. The lance 3 can also be divided into several segments so that there can be injection of fuel in these individual segments.

FIG. 2-4 also discloses the position of the moveable baffles 21*a*, 21*b*. Their function is to introduce the stream and, having different lengths, they extend the respective ends of the conical body segments 1 and 2 in the inflow direction of the combustion air 15. By opening or closing the moveable baffles 21*a*, 21*b* around pivot 23, the channelization of the combustion air into the cone cavity 14 can be optimized.

Figure 5:
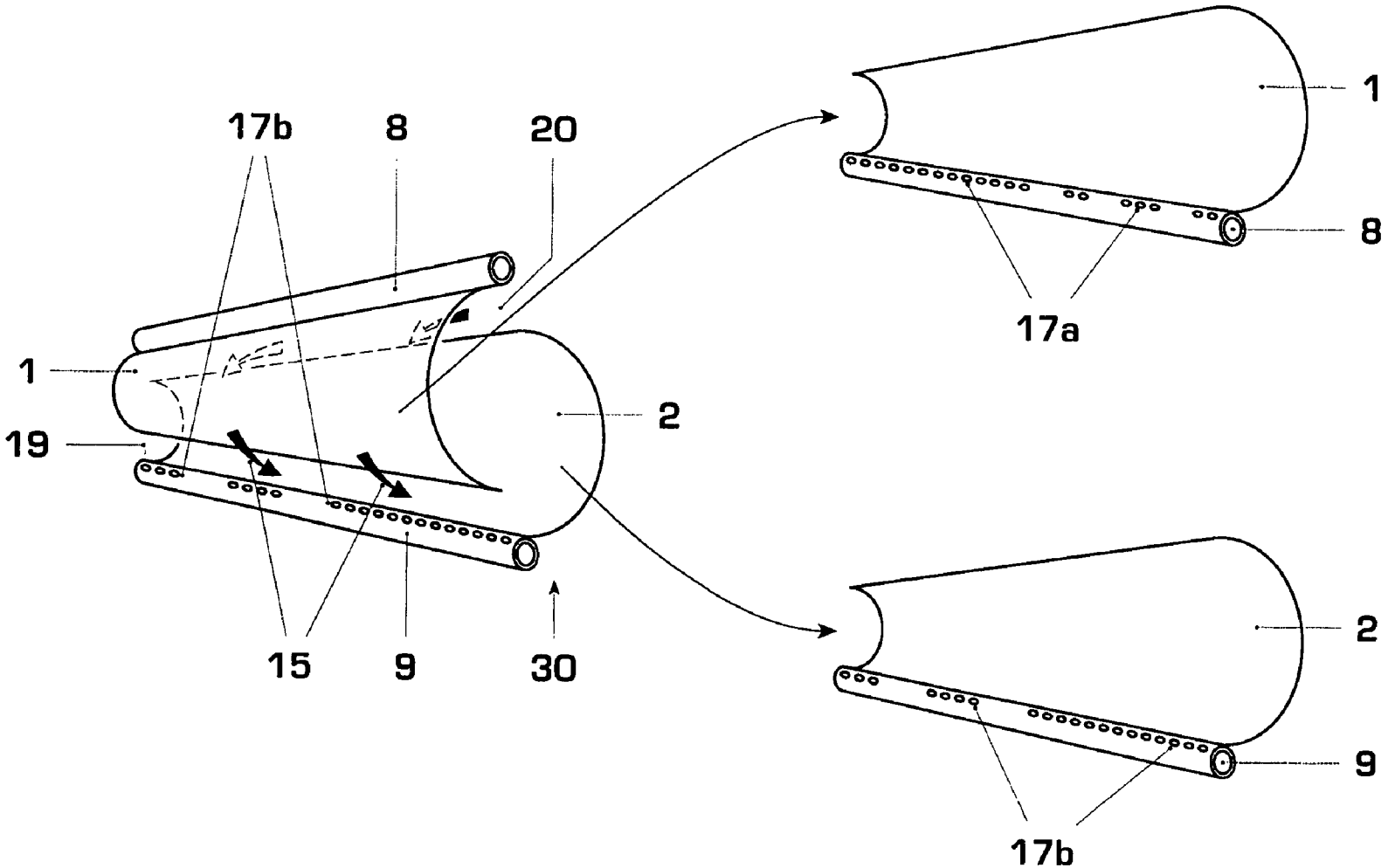
FIG. 5 a perspective view of a burner in accordance with the invention and with a presentation of the shells.

FIG. 5 shows the vortex generator 30 including conical body segment 1 with fuel line 8 and conical body segment 2 with fuel line 9 on the left side in operating position and on the right side in a comparable position so as to compare the embodiment of the two conical body segments. Openings 17*a* of the fuel line 8 are arranged asymmetrically with regard to openings 17*b* of the fuel line 9. Thus fuel openings 17*a* are arranged opposite the areas of fuel line 9 in which no fuel openings are arranged and fuel openings 17*b* therefore are arranged in areas opposite fuel line 8 in which no fuel openings are arranged. This generates an asymmetrical fuel profile when the fuel is injected into the combustion air. This asymmetrical arrangement of the fuel openings 17*a* and 17*a* and the resulting asymmetrical fuel profile ensure that pulsations are suppressed. The type and intensity of the generated asymmetry must be adapted to the respective individual case. Burner systems with low pulsation can have low asymmetry of fuel injection. In systems with high levels of pulsation asymmetry must be stronger.

Figure 6:
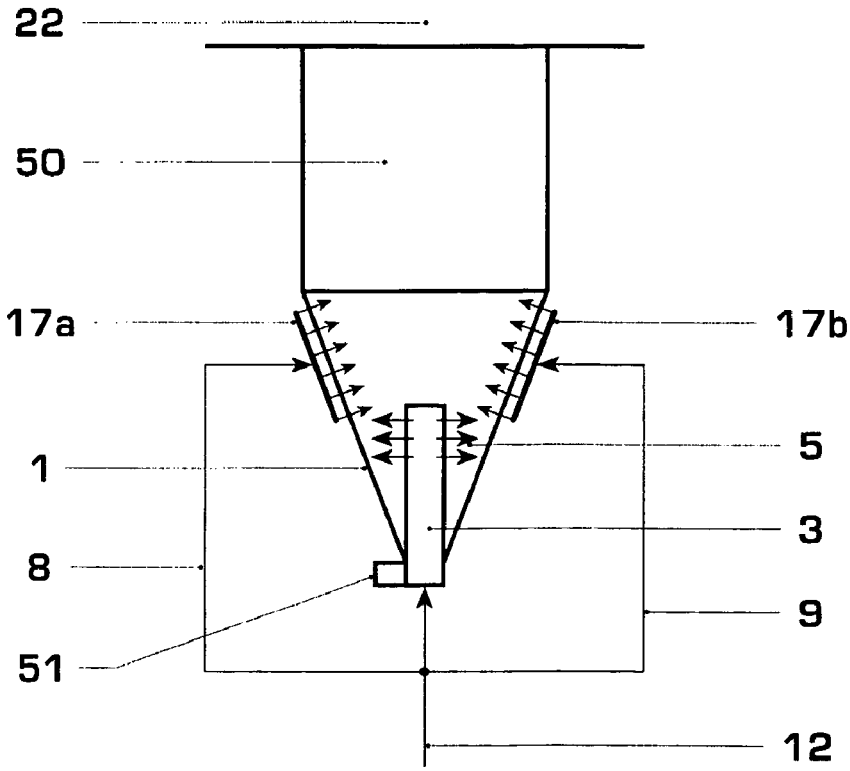
FIG. 6 another burner in accordance with the invention a presentation of the shells and mixer tube.

FIG. 6 shows a schematic view of a vortex generator whose function is known in principle from EP 0 704 657 A2, the disclosure of which is hereby included. According to the invention, however, the fuel injection is adapted. In principle the burner shown here includes a vortex generator 30 consisting of two conical body segments 1, 2 and a mixing tube 50 that is arranged downstream and to which combustion chamber 22 is connected downstream. Fuel lance 3 extends into cone cavity 14 in downstream direction. It has a fuel injection 5. The lance and the fuel injections 5 in this example are arranged in the cone cavity in a manner that ensures that the fuel injection occurs in the upper part of the cone cavity 14. Not shown is that additional injection openings can be arranged downstream on the lance that can be reached via separate fuel lines, for example.

Openings 17*a* of fuel line 8 and openings 17*b* of fuel line 9 are arranged in the downstream portion of the cone cavity 14. Fuel openings 17*a* and 17*b* therefore mainly are opposite areas in which no fuel openings 5 are arranged on the lance 3. This allows for an incremental introduction of fuel via lines 12 and 8 and 9. The injection via openings 17*a*, 17*b* can of course be asymmetrical as well as described for FIG. 5 above.

The fuel distribution system of the external pilot fuel injection on mixing tube 50 can be used for the fuel injection via the long lance 3.

Figure 7:
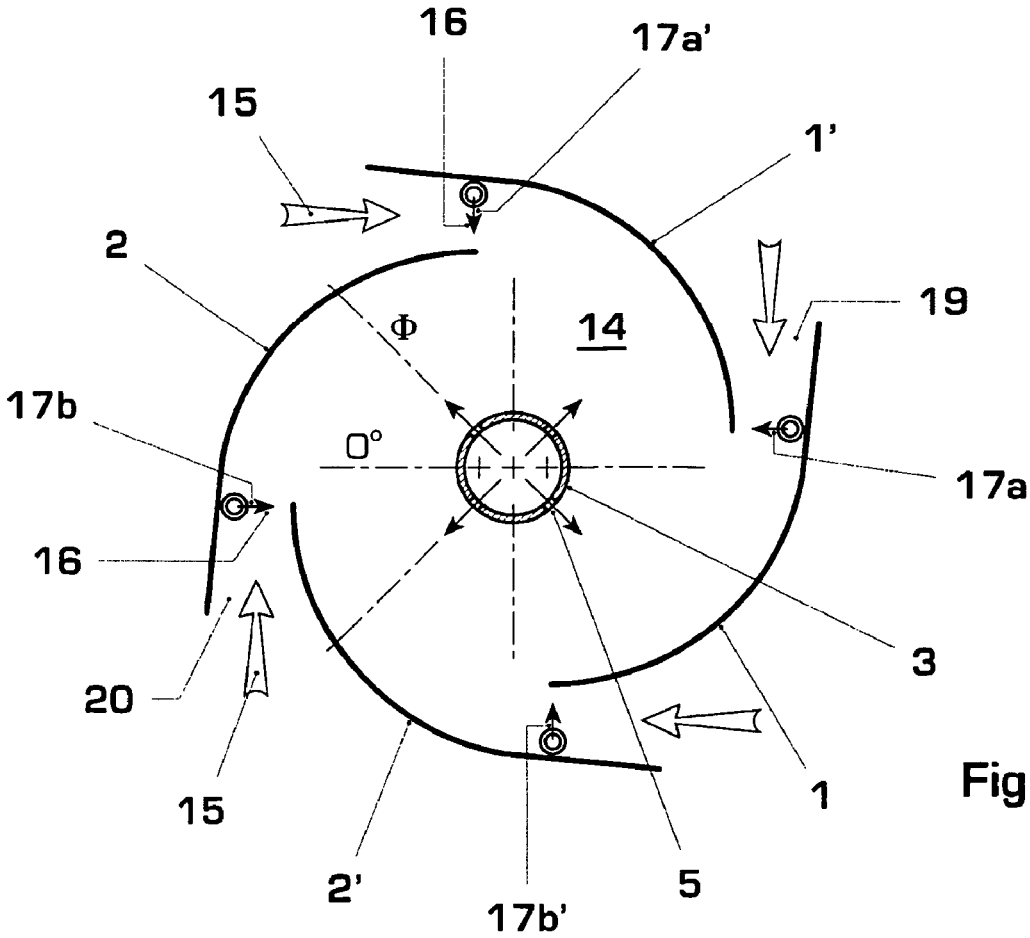
FIG. 7 a cross section through plane VII-VII in FIG. 6.

FIG. 7 shows a cross section through the Vortex generator shown in FIG. 6. The vortex generator shown here includes four conical body segments 1, 1', 2, 2' on which gas injection openings 17*a*, 17*a'*, 17*b*, 17*b'* are arranged in the area of the tangential air ducts. The gas exit openings 5 of the lance are rotated at an angle Φ with regard to gas injection openings 17*a*, 17*a'*, 17*b*, 17*b'*. Angle Φ can be adjusted so that the desired asymmetry is achieved. The rotation can also be 0°, which means that there is no asymmetry, which can be advantageous for certain operating states. Angle Φ can also be adjusted during operation so that the desired asymmetry can be adjusted for any operating state. The lance can be arranged in a pivoting manner and can be rotated via a drive 51, e.g. a step motor, ref. FIG. 6.

Figure 8:
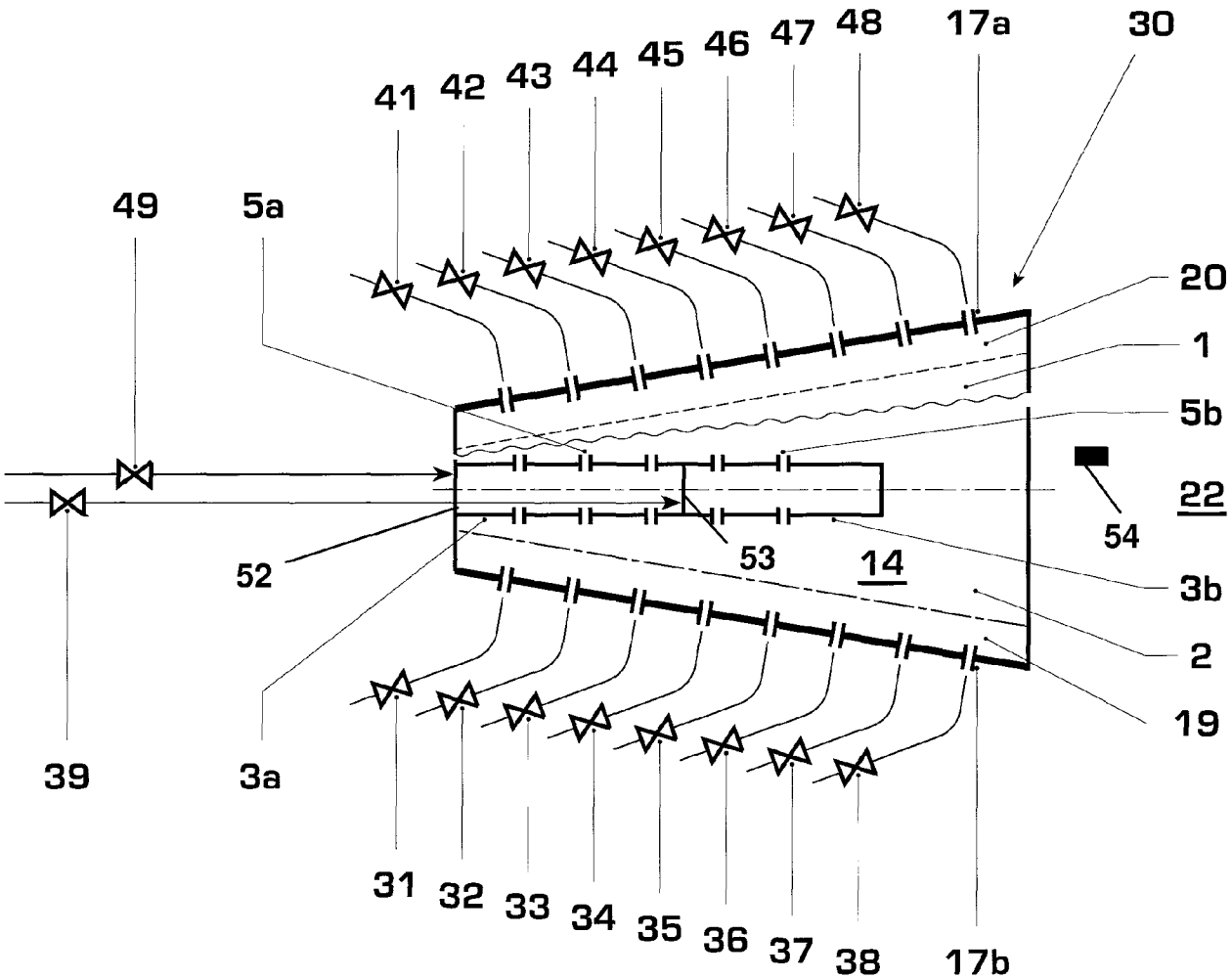
FIG. 8 a double-cone burner according to the invention with individually controllable fuel jets.

FIG. 8 shows another embodiment of the double-cone burner in accordance with the invention. The cone cavity 14 includes conical body segments 1 and 2. The combustion air flows into the cone cavity 14 via tangential air ducts 19 and 20. Fuel injection openings 17*a* and 17*b* are arranged in the area of the tangential air ducts 19, 20 through which fuel can be injected into the combustion air. The resulting fuel-air mixture is transported into the combustion chamber and ignited. In this example the double-cone burner has eight fuel injection openings 17*a* and 17*b* on each tangential air duct 19, 20 that are individually supplied with fuel via a line. A valve 31 through 38 or 41 through 48 respectively is arranged in each of these lines and each of these valves can be controlled, independent of the others. To arrive at an asymmetry, opposite fuel injection openings 17*a* and 17*b* are controlled via valves 31 and 41, 32 and 42, 33 and 43 etc. in a manner that ensures that at least one of the eight opposite pairs of fuel openings has a different fuel mass flow with regard to the respective opposite fuel opening, resulting in asymmetrical fuel supply.

The fuel supply to the lance is accomplished via two fuel lines in which a fuel valve 39 and 49 each is arranged. The lance is divided into a downstream segment 3*b* and an upstream segment 3*a* and each of these segments, independent of each other, can be supplied with fuel. Valve 39 triggers segment 3*b* and valve 49 triggers segment 3*a*. By opening valves 39 and 49 fuel can flow into the cone cavity via openings 5*b* and 5*a*. Segments 3*a* and 3*b* of the fuel lance can be rotated, schematically represented in FIG. 8 at 52, 53, analogously to FIGS. 6 and 7. Advantageously the rotation of segments 3*a* and 3*b* can be independent of each other which provides a higher degree of asymmetry. Depending on the requirements, the lance can of course be divided into even more segments analogously to the above description.

Sensors 54 in the combustion chamber 22 determine the degree of pulsation so the degree of asymmetry can be adjusted to the conditions by means of the fuel injection openings 3*a*, 3*b*, 17*a* and 17*b* and the respective valve pairs 31 and 41, etc. as well as 39 and 49. This control of the asymmetry of course can be combined with an incremental combustion in accordance with the disclosure of DE 100 64 893 A1, whose disclosure is hereby included, in order to prevent damaging pulsation even more effectively.

When retooling existing facilities or planning new facilities the fuel distribution system of the external pilot fuel injection for fuel injection via long lances can be used. As is customary for incremental internal fuel systems for burners, all fuel injection stages are in operation at least during full load conditions.

Also, it would be possible to not only forego a part of the injection into a premix channel, i.e. into a tangential air duct, as described above, but to forego it completely. In this case the fuel would be injected completely via the lance.

Of course the invention is not limited to the exemplary embodiment that is shown and explained. The embodiment according to FIG. 5 of course can also be combined with the embodiment according to FIG. 8. This can minimize the active control of the valves.

Of course it is possible to adapt the number of fuel openings and thus the number of valves according to the requirements. The burner can also have different shapes than the one shown in the exemplary embodiment and it is possible to use different types of burners. The burner that is shown can be varied freely with regard to shape and size of the tangential air ducts 19, 20. The number of partial body segments of the vortex generator can be chosen freely.

REFERENCE LIST

1 conical body segment
1*a* cylindrical part
1*b* centerline conical body segment 1
2 conical body segment
2*a* cylindrical part
2*b* centerline conical body segment 2
3 fuel lance
3*a* fuel lance upstream segment
3*b* fuel lance downstream segment
4 fuel injection
5 lance openings
5*a* upstream lance openings
5*a* downstream lance openings
6 backflow zone
7 flame front
8 fuel line
9 fuel line
10 back plate
11 hole
12 gaseous fuel
13 gaseous fuel
14 vortex body, cone cavity
15 combustion air
16 mixing
17 openings
17*a* openings fuel line 8
17*b* openings fuel line 9
18 cooling air
19 tangential air duct
20 tangential air duct
21*a* moveable baffle
21*b* moveable baffle
22 combustion chamber
23 pivot
29 burner outlet
30 vortex generator
31-38 valves of the fuel jets at the first air duct
39 valves of the fuel jets lance 3*b*
41-48 valves of the fuel jets at the second air duct
49 valves of the fuel jets lance 3*a*
50 mixing tube
51 step motor While the invention has been described in detail with reference to exemplary embodiments thereof, it will be apparent to one skilled in the art that various changes can be made, and equivalents employed, without departing from the scope of the invention.

The invention claimed is:

1. A premix burner comprising:

a vortex generator for an combustion air stream, the vortex generator including a cone cavity;

means for injecting fuel into the combustion air stream;

tangential air ducts through which the combustion air stream enters the vortex generator cone cavity; and a fuel lance extending into the cone cavity;

wherein the means for injecting fuel is further for incrementally injecting fuel into the combustion air, and wherein at least a portion of the means for injecting fuel is arranged on the fuel lance;

wherein the fuel lance is divided into at least two partial lances and the partial lances are configured and arranged to be rotated by any angle (Φ).

2. A premix burner according to claim 1 wherein the means for injecting fuel includes at least a portion on the vortex generator, and wherein the portion of the means for injecting fuel on the fuel lance is offset by an angle (Φ) relative to the portion of the means for injecting fuel on the vortex generator.

3. A premix burner according to claim 1, wherein the vortex generator has at least two tangential air ducts that are opposite with regard to the symmetry of the vortex generator.

4. A premix burner according to claim 1, wherein at least a portion of the means for injecting fuel is arranged in the area of the tangential air ducts.

5. A premix burner according to claim 1, wherein the means for injecting fuel comprises fuel injection openings opposingly arranged on at least some of the tangential air ducts and are arranged at least partially asymmetrical in the direction of flow so that said opposingly arranged fuel injection openings are arranged asymmetrically.

6. A premix burner according to claim 5, further comprising:

fuel injection controls configured and arranged to control the flow of fuel to the fuel injection openings; and wherein the fuel injection openings include at least one pair of primarily symmetrically opposing fuel injection openings the flow of fuel to which is controlled by respective fuel injection controls so that more fuel exits from one of said pair of fuel injection openings than from the other of said pair of fuel injection openings.

7. A premix burner according to claim 6, wherein at least some of the symmetrically opposing pairs of fuel injection openings or lance fuel injections are controlled via respective fuel injection controls to generate an incremental fuel profile in the direction of flow.

8. A premix burner according to claim 1, wherein the fuel lance is divided into at least two partial lances each including fuel injection openings configured and arranged to be individually supplied with fuel.

9. The premix burner according to claim 1, comprising a double-cone burner including the vortex generator formed of at least two hollow conical body segments on top of each other that expand in the direction of flow and are offset with regard to each other to form said tangential air ducts so that the combustion air flows across the tangential air ducts and into the cone cavity.

10. The premix burner according to claim 9, further comprising:

a mixing tube arranged downstream of the vortex generator.

11. A premix burner comprising:

a vortex generator for an combustion air stream, the vortex generator including a cone cavity;

means for injecting fuel into the combustion air stream;

tangential air ducts through which the combustion air stream enters the vortex generator cone cavity; and a fuel lance extending into the cone cavity;

wherein the means for injecting fuel is further for incrementally injecting fuel into the combustion air, and wherein at least a portion of the means for injecting fuel is arranged on the fuel lance;

wherein the means for injecting fuel includes at least a portion on the vortex generator; and wherein the portion of the means for injecting fuel on the fuel lance is configured and arranged to be rotated by any angle (Φ) relative to the vortex generator portion of the means for injecting fuel during operation of the burner.

12. A premix burner comprising:

a vortex generator for a combustion air stream, the vortex generator including a cone cavity;

means for injecting fuel into the combustion air stream including fuel injection openings;

tangential air ducts through which the combustion air stream enters the vortex generator cone cavity; and a fuel lance extending into the cone cavity;

wherein the means for injecting fuel is further for incrementally injecting fuel into the combustion air, and wherein at least a portion of the means for injecting fuel is arranged on the fuel lance;

fuel injection controls configured and arranged to control the flow of fuel to the fuel injection openings;

wherein the fuel injection openings include at least one pair of primarily symmetrically opposing fuel injection openings the flow of fuel to which is controlled by respective fuel injection controls so that more fuel exits from one of said pair of fuel injection openings than from the other of said pair of fuel injection openings;

a combustion chamber downstream of the vortex generator;

sensors configured and arranged to measure pulsation arranged in the combustion chamber downstream of the vortex generator; and means for adjusting the degree of asymmetry of the fuel injection according to the degree of the measured pulsation.

* * * * *